United States Patent [19]

Schwartz

[11] Patent Number: 4,750,784

[45] Date of Patent: Jun. 14, 1988

[54] CHAIRS HAVING DETACHABLE BACKS

[75] Inventor: Larry A. Schwartz, Hartsdale, N.Y.

[73] Assignee: Omni Products International, Inc., Fairfield, N.J.

[21] Appl. No.: 67,277

[22] Filed: Jun. 26, 1987

[51] Int. Cl.[4] ..... A47C 7/00

[52] U.S. Cl. ..... 297/444; 297/447; 297/452

[58] Field of Search ..... 297/440, 444, 447, 288, 297/287, 294, 421, 452

[56] References Cited

U.S. PATENT DOCUMENTS

| | | | |
|---|---|---|---|
| 56,718 | 7/1866 | Coomes | 297/444 |
| 2,158,225 | 5/1939 | Elmore | 297/447 |
| 2,209,145 | 7/1940 | Weber | 297/440 X |
| 2,564,915 | 8/1951 | Nelson | 297/287 |
| 2,625,988 | 1/1953 | MacMillan | 297/444 X |
| 2,668,584 | 2/1954 | Greitzer | 297/444 |
| 2,694,438 | 11/1954 | Frech | 297/440 X |
| 2,871,921 | 2/1959 | Arnold | 297/45 X |
| 3,114,578 | 12/1963 | Hamilton | 297/444 |

FOREIGN PATENT DOCUMENTS

| | | | |
|---|---|---|---|
| 468799 | 1/1952 | Italy | 297/421 |
| 668207 | 3/1952 | United Kingdom | 297/447 |

*Primary Examiner*—Francis K. Zugel

*Attorney, Agent, or Firm*—Lerner, David, Littenberg, Krumholz & Mentlik

[57] ABSTRACT

A dissassemblable chair structure is provided having a conventional lower chair seat section and an upper chair back section. Manually releasable fastening means are provided for detachably assembling the upper chair back section without the use of tools. The lower chair seat section includes legs, a seat portion and, optionally, arm rests, all of which are permanently fastened together. The upper chair back section includes a U-shaped frame member the legs of which are preferably sufficiently flexible to allow them to be moved toward or away from one another slightly during assembly of the upper and lower sections of the chair to compensate for manufacturing tolerance misalignments that may exist between the two sections. A lower cross bar member and resilient straps may be provided on the upper seat back section to increase the strength and comfort of the seat back section.

10 Claims, 2 Drawing Sheets

FIG. 1
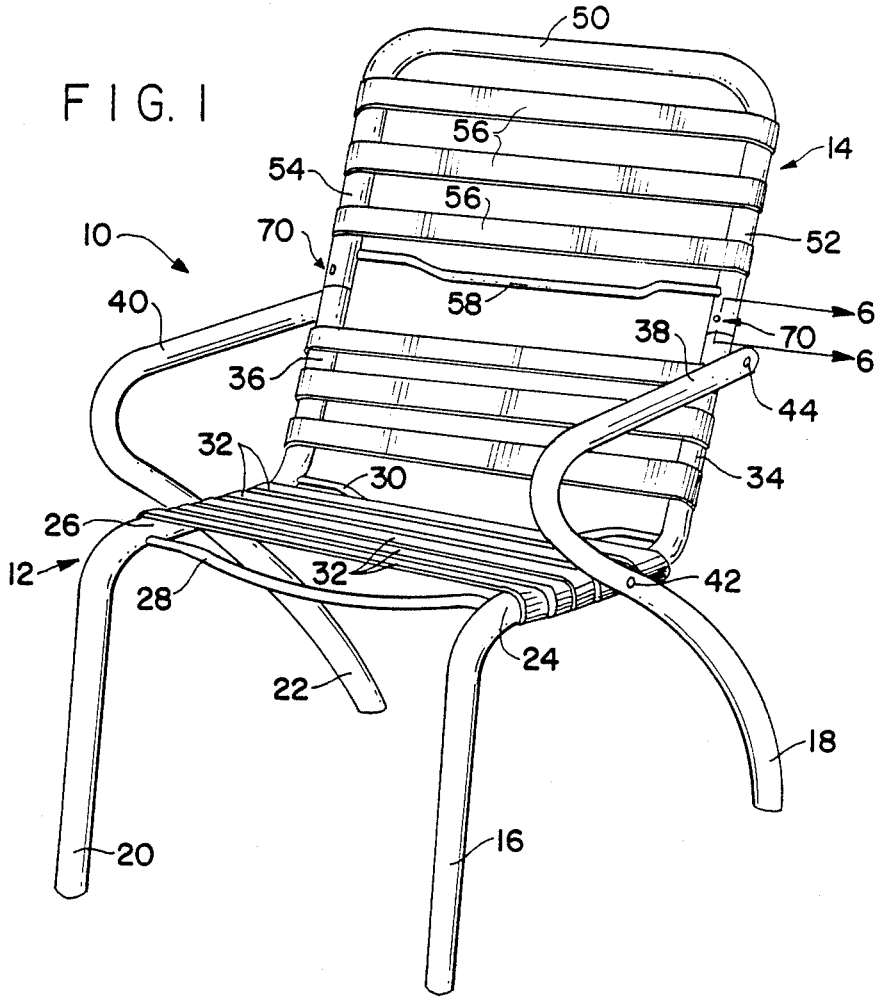
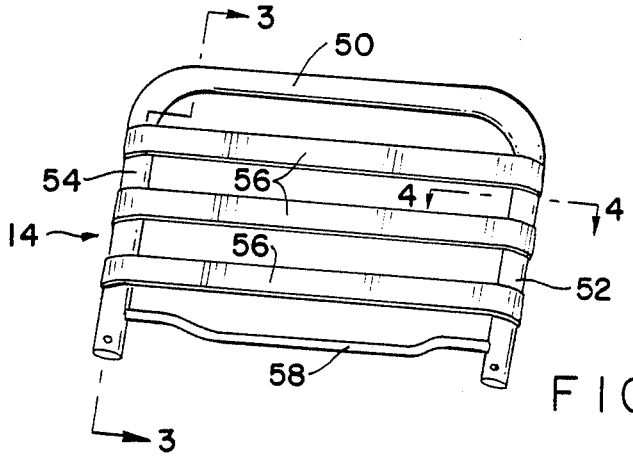
FIG. 2

CHAIRS HAVING DETACHABLE BACKS

BACKGROUND OF THE INVENTION

This invention relates to chair structures and, more particularly, to chairs having detachable backs.

Conventional chairs are bulky and therefore expensive to ship and difficult to store. The volume occupied by an assembled chair usually is far greater than the volume occupied by the same chair in a disassembled condition. Accordingly, various proposals have heretofore been advanced for making chairs which can be supplied as a kit of compact disassembled components and which can be readily assembled at the ultimate point of use. One example of such disassembled chairs may be seen in my co-pending application Ser. No. 034,892, filed Apr. 3, 1987.

Although the manufacture and the sale of disassembled chairs affords considerable savings and convenience in shipping and distributions costs, and facilitates storage by the consumer, such chair structures heretofore have not been truly satisfactory in all respects. For example, the assembled chairs have not had the strength to withstand loads imposed on them in service, without bending or deflecting unduly, and do not provide the user with the feeling of rigidity and strength found in high quality conventional chair structures. In addition disassembled chair structures heretofore have required user-provided tools and significant mechanical skills for assembly, making their assembly difficult for consumers having little or no mechanical aptitude. Also, manufacturing tolerances in the chain manufacturing field frequently result in misalignments between parts requiring assembly that makes such assembly difficult to accomplish in the absence of special provisions to facilitate the same.

It is, therefore, a primary object of the present invention to provide an improved chair structure which is partially disassemblable, so as to provide for compact storage, but that requires no tools or mechanical skills on the part of the user to reassemble the chair.

Another object of the present invention is to provide an improved chair structure that is partially disassemblable to allow compact storing but has suffficient strength, when assembled, to withstand normal loads found in service and to provide the user with the feeling of rigidity and strength that the user expects to find in high quality conventional chair constructions.

Yet another object of this invention is to provide features in an assemblable chair structure that will facilitate assembly of the chair structure notwithstanding misalignment, due to excessive manufacturing tolerances, of the parts being assembled.

Further objects and advantages of the invention will become apparent as the following description proceeds.

SUMMARY OF THE INVENTION

Briefly stated and in accordance with one embodiment of this invention, an improved disassemblable chair structure preferably includes a conventional lower chair seat section having legs, a seat portion and, optionally, arm rests which are permanently interlocked and fastened together, and an upper chair back section which is detachably assemblable to the lower chair seat section without requiring the use of any tools. The upper chair back section may include a U-shaped frame member the legs of which are sufficiently flexible to allow them to be moved toward or away from each other slightly in order to allow them to line up with corresponding frame members on the lower chair back section of the chair structure during assembly of the upper and lower sections of the chair. This compensates for any manufacturing tolerance misalignment that may exist between the two sections.

BRIEF DESCRIPTION OF THE DRAWINGS

While the specification concludes with claims particularly pointing out and distinctly claiming the subject matter reqarded as the invention herein, it is believed that the present invention will be more readily understood from the following description, taken in conjunction with the accompanying drawings, in which:

FIG. 1 is a perspective view of a chair structure having a permanently assembled lower chair seat section and a removable upper chair back section in accordance with one embodiment of this invention;

FIG. 2 is a perspective view of the upper chair back section of the chair structure shown in FIG. 1;

Figure 3:
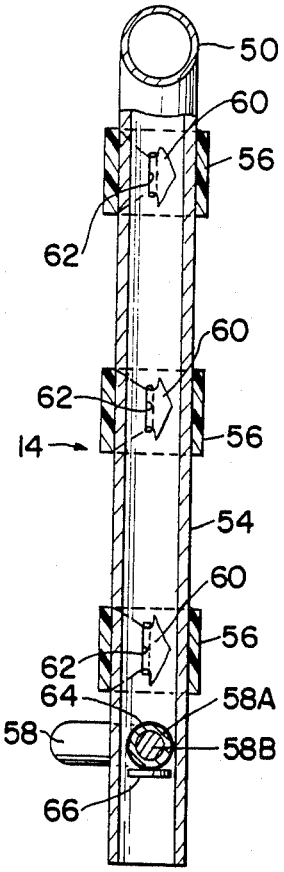
FIG. 3 is an enlarged sectional elevational view, taken along the line 3—3 of FIG. 2.

Referring to the figures, a chair structure, shown generally at 10 (FIG. 1), has there been illustrated. The chair structure 10 includes a non-disassemblable lower chair seat section, shown generally at 12, and a removable upper chair back section, shown generally at 14.

The lower chair seat section 12 includes a left side pair of leg members, including front leg member 16 and rear leg member 18, and a right side pair of leg members, including front leg member 20 and rear leg member 22. The front leg members 16 and 20 are preferably integral with corresponding left-side and right-side seat members 24 and 26, respectively, which are held in spaced apart relation by front and rear cross bars 28 and 30, respectively. A plurality of resilient straps 32 extend across the space between seat member 24 and 26 and are fastened at one or another of their opposite ends to the corresponding left-side and right-side seat members, biasing the members toward oen another against the cross bars 28, 30. The resilient straps 32 form a generally planar seat means which the user may sit upon.

The lower chair seat section 12 also includes left-side and right-side upwardly projecting, lower back frame means or members 34 and 36, respectively, which are preferably integral with and extensions of the left-side and right-side seat members 24 and 26, respectively. The lower chair seat section 12 also, optionally, includes left-side and right-side arm rests 38 and 40, respectively, which are preferably integral with and extensions of the rear leg members 18 and 22, respectively.

The lower end of left-side arm rest 38, and the upper end of left-side leg member 18 integral therewith, are permanently fastened to the left-side seat member 24 by means of a bolt fastener 42. A similar bolt (not shown) is employed to fastent he lower end of right-side arm rest 40, and the upper end of right-side leg member 22 integral therewith, to the right-side seat member 26. The opposite ends of the left-side and right-side arm rest members 38, 40 are fastened to the corresponding upwardly projecting, lower back frame members 34 and 36 by means of corresponding bolts, one of which is shown at 44. The construction of the lower chair seat section 12 is such that a generally nondisassemblable chair is provided which is able to withstand any normal loads imposed upon it in service, without unduly bending or deflecting, so as to provide the user with a feeling of rigidity and strength that is found in high quality chair structures.

Referring now more particularlty to FIGS. 2–7, the removable upper chair back section 14 will now be considered in greater detail. The upper chair back section 14 includes a rigid upper cross member or means 50 having left-side and right-side downwardly extending, upper back frame leg members or means 52 and 54, respectively, integral with or permanently connected at their upper portions to corresponding end portions of the cross mnember 50. The members 50, 52 and 54 generally form a U-shaped structure the leg members 52 and 54 of which are inter-connected by a plurality of resilient straps 56 which tend to bias the leg members 52 and 54 toward one another. The leg members 52 and 54 are held in spaced apart relation by a cross bar member 58 that keeps the lower ends of the frame members 52 and 54 spaced apart by a minimum distance but allows them to be manually moved apart against the resilient force of the strap members 56 so that the lower ends of the frame members 52 and 54 may be aligned with the upper ends of the upwardly projecting, lower back frame members 34 and 36 in connection with assembling the upper chair back section 14 to the lower chair seat section 12.

Figure 4:
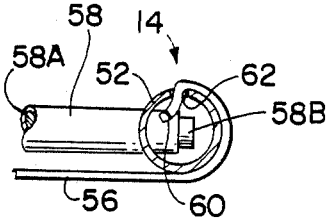
FIG. 4 is an enlarged sectional plan view, taken along the line 4—4 of FIG. 2.
Figure 5:
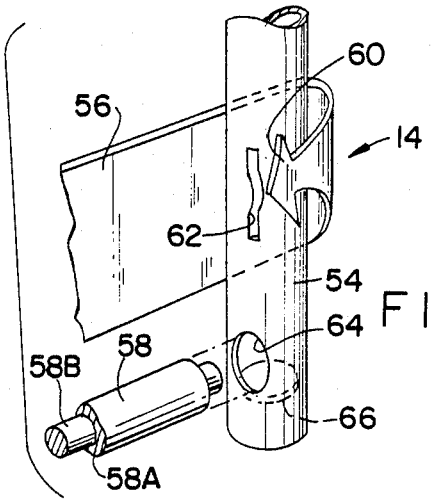
FIG. 5 is an enlarged partial perspective view, showing details of construction of the upper chair back section.

As shown most clearly in FIGS. 3–5, the ends of the resilient straps 56 are provided with arrow-shaped portions 60 that wrap around the corresponding frame members 52 and 54, which are tubular in cross section, and pass through slots 62 into the interior of the tubular members 52, 54 to thereby lock the ends of the straps 56 in place. The slots 62 are preferably slightly shorter in length that are the vertical heights of the arrow-shaped end portions 60 so that once assembled, the two parts will not accidentally pull apart but, rather, will require specific, strenuous exertion to break the connection therebetween.

As also shown in FIGS. 3–5, the cross bar member 58 is preferably comprised of an outer tubular member 58A and an inner rod member 58B which, together, provide the necessary strength required of the cross bar member 58. The ends of the cross bar member 58 project through apertures, one of which is shown at 64, into the interiors of the leg members 52, 54. They rest upon platforms, one of which is shown at 66, in the interiors of the leg members 52, 54, which platforms are formed when the apertures 64 are punched into the leg members. The cross bar members 28 and 30 (FIG. 1) are also constructed in a manner similar to cross bar member 58 for strength purposes. They fit into apertures (not shown) corresponding to apertures 64 and are supported by platforms (not shown) corresponding to platforms 66. Each of the cross bar members 28, 30 and 58 is provided with a conventional curved central portion so that such curved portion will be clear the user's seat or back when the user is seated upon the chair.

Figure 7:
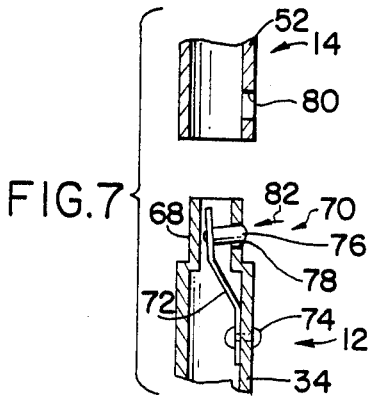
FIG. 7 is a sectional elevation view, similar to FIG. 6, showing the fastening means in an unlocked condition in connection with separating the upper and lower chair sections from one another.
Figure 6:
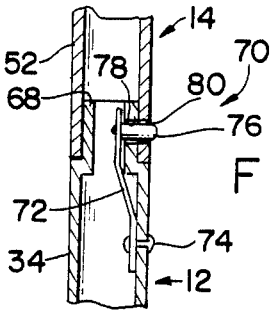
FIG. 6 is an enlarged sectional elevation view, taken along the line 6—6 of FIG. 1, showing details of manually releasable fastening means which are employed to lock the upper and lower chair sections together.

Referring now to FIGS. 1, 6 and 7 manually releasable fastening means, showing generally at 70, are employed to releasably hold together the upper back frame members 52 and 54 with the lower back frame members 34 and 36. Preferably, the upper ends of lower back frame members 34 and 36 are swaged as shown at 68 so that they may be telescopically inserted into the lower ends of the upper back frame members 52 and 54 to form a tight fit therebetween. The fastening means 70 each include a leaf spring member 72 that is riveted to the interior of the lower back frame members 32, 34 by a rivet 74 and carries adjacent its upper end a lug or protrusion 76 that is riveted or otherwise fastened to the upper end of the leaf spring member. The protrusion 76 is normally biased by leaf spring member 72 to the position shown in FIG. 6, wherein it projects through an orifice 78 in the swaged portion 68 of lower back frame members 32, 34, into engagement with an orifice 80 in the lower portion of the upper back frame members 52, 54, locking the upper back frame members 52, 54 to the lower back frame members 34, 36.

As shown in FIG. 7, when the protrusion 76 is depressed by applying a force thereto in the direction of the arrow 82, it is moved clear of the orifice 80 in the upper back frame members 52, 54, allowing the upper chair back section 14 to be removed from the lower chair seat section 12. This allows the two sections to disassembled from one another for shipping or storage purposes.

From the foregoing description, it will be apparent that the invention provides a rigid composite chair structure having a non-disassemblable lower chair seat section and a removable upper chair back section. The two sections of the chair structure can be separated from one another, without requiring the use of any tools, by a user who need not have any significant mechanical aptitude. The U-shaped upper chair back section, which is supported at its lower end by a loosely fitting cross bar, facilitates the adjustment of the lower ends of the upper chair section so as to easily align the same with the upper ends of the lower chair back portion, notwithstanding any manufacturing tolerance misalignment that may be present in the chair as manufactured, and the resilient bands on the upper chair back section prevent the downwardly depending frame members from separating sufficiently to allow the cross bar member 58 to fall out from one or the other of the apertures in which it is received.

While a particular embodiment of this invention has been shown and described, it will be obvious to those sklled in the art that various changes and modifications may be made without departing from this invention in its broader aspects, and it is, therefore, aimed in the appended claims to cover all such changes and modifications as fall within the true spirit and scope of this invention.

What is claimed is:

1. A chair structure comprising a lower chair seat section and an upper chair back section, said lower chair seat section including a plurality of leg members, a seat means permanently interconnecting said leg members, and left-side and right-side upwardly projecting lower back frame means permanently fixed to said seat means, said upper chair back section including a flexible, generally U-shaped assembly comprising an upper cross member means and left-side and right-side downwardly extending upper back frame means permanently connected at their upper portions to corresponding end portions of said cross member means, said upper chair back section further including a lower cross member means loosely interconnecting the lower portions of said right-side and left-side downwardly extending upper back frame means, whereby said lower portions of said back frame means may be flexed toward and away from one another to facilitate alignment thereof with corresponding ones of said upwardly projecting lower back frame means, said downwardly extending left-side and right-side upper back frame means being constructed and arranged to rigidly, releasably engage with said corresponding left side and right-side upwardly projecting lower back frame means thereby to form a rigid, composite chair structure having a non-disassemblable lower chair seat section and a removable upper chair back section.

2. A chair structure according to claim 1, further including arm rest members carried by said lower chair seat section at each side thereof, one end portion of each of said arm rest members being fixed to corresponding ones of said upwardly projecting lower back frame members, and the other end portion of each of said arm rest members being fixed to corresponding sides of said seat means.

3. A chair structure according to claim 2, wherein said other end portion of each of said arm rest members is integral with a corresponding one of said leg members.

4. A chair structure according to claim 3, wherein said seat means includes a longitudinal support member positioned on each side thereof, and wherein each of said longitudinal support members is integral with a corresponding one of said leg members.

5. A chair structure according to claim 4, wherein each of said upwardly projecting lower back frame means is integral with a corresponding one of said longitudinal support members.

6. A chair structure comprising a lower chair seat section and an upper chair back section, said lower chair seat section including a left-side pair of leg members and a right-side pair of leg members,. left-side and right-side seat members rigidly interconnecting the upper portions of said respective left-side and right-side pairs of leg members, and left-side and right-side upwardly projecting lower back frame members, comprising a pair of such members, fixed to said respective left-side and right-side seat members, said upper chair back section including a flexible, generally U-shaped assembly comprising an upper cross member and first and second downwardly extending upper back frame members, comprising a pair of such members, fixed at their upper end portions to corresponding side portions of said cross member and constructed and arranged to engage with said upwardly projecting lower back frame members, said upper chair back section further including a rigid lower cross member loosely interconnecting the lower portion of said right-side and left-side downwardly extending upper back frame members, whereby said lower portions of said back frame members may be flexed toward and away from one another to facilitate alignment thereof with corresponding ones of said upwardly projecting lower back frame members; and manually releasable fastening means carried by each of the back frame members in one of said pairs of back frame members and engageable with corresponding back frame members in the other of said pairs of back frame members for releasably holding together said pairs of back frame members.

7. A chair structure according to claim 6, further including arm rest members carried by said lower chair seat section at each side thereof, one end portion of each of said arm rest members being fixed to corresponding ones of said upwardly projecting lower back frame members, and the other end portion of each of said arm rest members being fixed to corresponding ones of said seat members.

8. A chair structure according to claim 7, wherein said other end portion of each of said arm rest members is integral with a corresponding one of said leg members.

9. A chair structure according to claim 8, wherein each of said left-side and right-side seat members is integral with a corresponding one of said leg members.

10. A chair structure according to claim 9, wherein each of said upwardly projecting lower back frame members is integral with a corresponding one of said left-side and right-side seat members.

* * * * *